United States Patent [19]

Siikarla

[11] Patent Number: 5,030,940

[45] Date of Patent: Jul. 9, 1991

[54] ELECTRONIC ARTICLE SURVEILLANCE TAG AND METHOD FOR IMPLEMENTING SAME

[75] Inventor: Risto Siikarla, Boca Raton, Fla.

[73] Assignee: Sensormatic Electronics Corporation, Deerfield Beach, Fla.

[21] Appl. No.: 561,787

[22] Filed: Aug. 2, 1990

[51] Int. Cl.[5] ..... G08B 13/14; H01Q 1/36

[52] U.S. Cl. ..... 340/572; 340/505; 343/895

[58] Field of Search ..... 340/572, 505; 343/894–895; 307/319

[56] References Cited

U.S. PATENT DOCUMENTS

| | | | |
|---|---|---|---|
| 4,413,254 | 11/1983 | Pinneo et al. | 340/572 |
| 4,642,640 | 2/1987 | Woolsey et al. | 340/572 X |
| 4,736,207 | 4/1988 | Siikarla et al. | 343/895 |

*Primary Examiner*—Glen R. Swanin, III
*Assistant Examiner*—Thomas J. Mullen, Jr.
*Attorney, Agent, or Firm*—Robin, Blecker, Daley & Driscoll

[57] ABSTRACT

In a method for enhancing the performance of tags for use in an electronic article surveillance system of the type comprising a transmitter-receiver arrangement disposed aside an area to be controlled for transmitting a first high-frequency signal into the area, a transmitter disposed aside the area and generating a second frequency signal of substantially lower frequency than the first frequency for establishing in the area an electrostatic field, a tag for attachment to an article to be subject to surveillance, the tag being responsive to the incidence thereon of energy of both the first and second frequencies to transmit a composite thereof and receiver apparatus disposed aside the area for receipt and detection of such composite signal and for generation of an output signal indicative of such detection, the method involving the steps of: configuring the tag with an antenna for receiving the first and second transmitted signals and for transmitting the composite signal; and a nonlinear circuit for connection electrically with the antenna and responsive to energy derived from the second transmitted signal received by the antenna to exhibit electrical reactance change with change of voltage of the energy; and applying an electrical bias of steady-state nature to the tag dependently on consideration of characteristics of the nonlinear circuit to enhance the electrical reactance change thereof responsively to the energy derived form the second transmitted signal received by the antenna. The considered characteristics of the nonlinear circuit are selected to be a dC/dV slope factor, a $1/c^2$ factor and a DC-impedance factor. The nonlinear circuit is selected to be a diode.

35 Claims, 8 Drawing Sheets

ELECTRONIC ARTICLE SURVEILLANCE TAG AND METHOD FOR IMPLEMENTING SAME

FIELD OF THE INVENTION

This invention relates generally to tag devices for use in electronic article surveillance systems and pertains more particularly to the provision of improved tag devices responsive to plural signals of diverse frequency and to practices for fabricating the same.

BACKGROUND OF THE INVENTION

The electronic article surveillance (EAS) industry has looked at large to tag devices of a type involving a dipole antenna housed with a diode in a protective envelope of insulative material. In some instances, EAS systems have provided for the transmission of a high frequency signal, such as a 915 megahertz carrier, and of a lower frequency signal, such as modulated 100 kilohertz. Widespread understanding, as evidenced in Pinneo et al. U.S. Pat. No. 4,413,254, is that such device defines a so-called "receptor-reradiator", returning to the receiver of the EAS system, the 915 MHz carrier with content related to the lower frequency and its modulation characteristic. Upon detection in the receiver of received signals inclusive of the modulation characteristic in given repetitive succession, an alarm indication is provided.

Generally, detection takes place in a controlled zone, i.e., an exit area of a retail establishment, and output alarm indication is that of a tag device being carried therethrough without authorization (undeactivated).

The art has come to realize substantial analytical evaluation of the activity at hand in EAS dipole and diode tag devices. Thus, in Woolsey et al. U.S. Pat. No. 4,642,640, there is a recognition of the need to establish circuit parameters which maximize the reception of the various signals transmitted, the need for establishing an inductive tag device character at the high frequency, where length parameters otherwise dictate, and the need of having a resonant circuit in the tag device at the high frequency.

In addressing such discerned needs, Woolsey et al. looked to the addition of inductance at 915 MHz selectively, as by a serpentine inductive path providing same within the length constraint at hand. Woolsey et al. thus looked not to the simple dipole/diode combination but to a discernment of specific diversely characterized tag device areas. They provided a generally rectangular tag configuration, devoting area to a circuit element which is inductive at the high frequency and is capacitive up to the lower frequency and other area to another circuit element, which is inductive at the high frequency, the circuit elements being physically disparate in geometry and arranged in electrical series circuit with the diode. There was a particular recognition that the sum of the various reactances of the circuit elements and that of the diode should give rise to situations wherein the diode is at the center of a resonant circuit, wherein the net sum of the various reactances at hand across the tag should then be zero and wherein the circuit elements should be addressed generally to different purposes, e.g., that one thereof should be such as to maximize second lower frequency energy receipt and hence voltage applied to the diode.

A further advance in the type of tag device under discussion is seen in Siikarla et al. U.S. Pat. No. 4,736,207 to which incorporating reference is hereby made. In its preferred form, the Siikarla et al. tag device is of generally rectangular configuration and comprises a first circuit element extending longitudinally of the device and of first transverse dimension, a second circuit element extending longitudinally of the device at least in part jointly with the first circuit element and of second transverse dimension substantially exceeding the first transverse dimension and effecting predominant different receipt by the first and second circuit elements of the high and low frequency transmitted signals and a further circuit element exhibiting voltage dependent capacitive reactance connected in electrical series circuit with the first and second circuit elements.

The third circuit element, which is typically a diode, has applied thereto the voltage generated in the tag device in response to the low frequency signal, which is cyclic. In practice under the '207 patent, one correlates the tag capability for the generation of voltage at the low frequency with capacitance change of the third circuit element, and vice versa, to enhance the magnitude of the phase reversals across the third circuit element, which generate the sidebands of the reradiated signal.

In the '640 patent, the principle underlying the reradiator element is that of an un-symmetrical dipole, which is folded back to conserve length. In the '207 patent tag device, the narrow sections form part of the radiating RF element of a symmetrical dipole. Again, as in the '640 patent, part of the pattern is folded back to conserve space.

In a copending and commonly-assigned application, Ser. No. 562,749 entitled "Electronic Article Surveillance System and Tag", there is provided a tag which incorporates a reradiator which is configured as a monopole. A monopole antenna typically requires only half as much length as a dipole and encompasses a ground plane to that effect. In customary monopole configurations, the ground plane is required to be perpendicular to the reradiator element of the monopole and of considerable size. This is because monopole radiator elements are of length normally near one-quarter wavelength and operate at or close to their natural resonance. Per the invention of the referenced copending application, however, the reradiator element has considerable inductive reactance and a large ground plane is neither required nor desirable. The resonant matching condition thus is controlled by impedances of the components of the monopole, such as its diode and a spiral reradiator element.

In the preferred embodiment of the invention of the referenced application, a tag uses a reradiator element which comprises a spirally wound inductor, which can be both very short and narrow without much loss of efficiency. The ground plane used is a reasonably narrow and short strip of conductive material and placed in line with the spiral element. By choosing a diode with suitable impedance characteristics, the limited size of the in-line ground plane can be made an integral part of the overall impedance matching system.

A significant and valuable feature of the invention of the referenced application is that all of the components are short, to conserve length, and narrow, to conserve width. Thus, a very compact tag design is achieved in accordance with that invention with performance comparable with existing larger tags.

SUMMARY OF THE INVENTION

The present invention has as its primary object the provision of improved EAS tags.

A particular object of the invention is to provide improved EAS tags of the type using low frequency electrostatic energy to reactance-modulate the tag diode capacitance with applied voltage.

In attaining this and other objects, the invention derives in part from a recognition of an opportunity for enhancement of the modulation reactance of certain nonlinear elements used as the third circuit elements or diodes of the above-discussed tag devices. Thus, applicant has determined that high frequency tag performance is inversely proportional to the square of the overall tag capacitance. More particularly, it is observed that, where a given nonlinear element exhibits capacitance change ratio of desired magnitude to provide good sideband generation at a high level of capacitance, high frequency performance deteriorates although low frequency performance is adequate. The invention thus looks to a compromise as between high and low frequency performances, and particularly observes that good low frequency performance can be attained without requiring nonlinear element capacitance which deteriorates high frequency performance.

In brief, the invention introduces, into either of the above-discussed or other tag devices, a bias voltage additive to the voltage across the nonlinear element derived from incident energy to effectively cause the nonlinear element to exhibit voltage change of enhanced magnitude on phase reversals.

The foregoing and other objects and features of the invention will be further understood from the following detailed description of a preferred embodiment thereof and from the drawings wherein like reference numerals identify like components and parts throughout.

DESCRIPTION OF PREFERRED EMBODIMENTS AND PRACTICES

Figure 1:
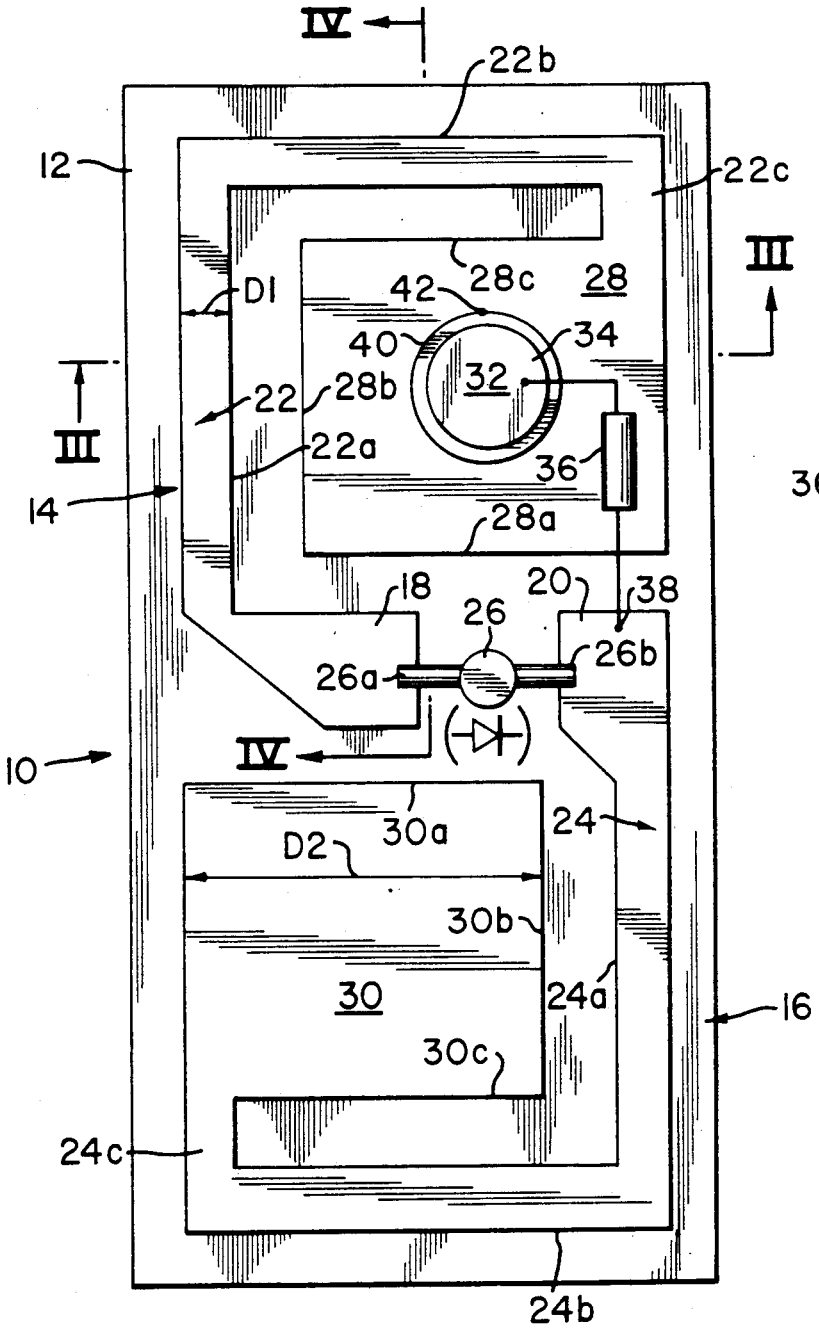
FIG. 1 is a top plan view of a first embodiment of a tag device in accordance with the invention.
Figure 2:
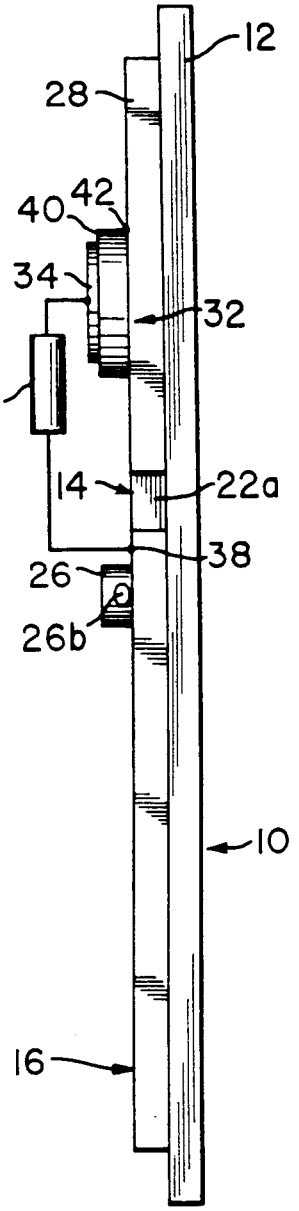
FIG. 2 is a right side elevation of the tag device of FIG. 1.

Referring to FIGS. 1 and 2, tag device 10 is of generally rectangular configuration and comprises an electrically insulative substrate 12 supporting various electrically conductive members. Such members comprise first circuit elements generally designated as 14 and 16, extending oppositely from the center of device 10 and including respectively transverse wings 18 and 20 and courses 22 and 24 of first transverse dimension D1. Courses 22 and 24 each include longitudinal portions **22*a* and 24*a* extending to opposed ends of substrate 12, transverse portions 22*b* and 24*b* and terminal portions 22*c* and 24*c*. Diode 26 is connected by its leads 26*a* and 26*b* in electrical series circuit with first circuit elements 14 and 16**.

The conductive members further include second circuit elements designated as 28 and 30 and of generally square outline and inclusive of respective transverse interior margin parts **28*a* and 30*a*, in spaced parallel relation with wings 18 and 20, respective longitudinal interior margin parts 28*b* and 30*b*, in spaced parallel relation with first circuit element portions 22*a* and 24*a*, and respective transverse outer marginal parts 28*c* and 30*c*, in spaced parallel relation with first circuit element portions 22*b* and 24*b*. Second circuit elements 28 and 30 are electrically continuous with terminal portions 22*c* and 24*c* of the first circuit element courses 22 and 24**.

The transverse dimension of second circuit elements 28 and 30, indicated at D2, is substantially in excess of the transverse dimension D1 of first circuit elements 22 and 24, typically some five or more times D1, the geometric diversities of such circuit elements being assigned with a view toward providing selective different fixed inductive and capacitive reactances therein at the first and second frequencies received by tag device 10.

The tag device 10 thus far discussed is shown in the '207 patent incorporated by reference above and further details as respects circuit element design may be obtained from the '207 patent. In accordance with the present invention, battery 32 has its negative terminal 34 connected through resistor 36 to first circuit element 16 at connection location 38 and its positive terminal 40 connected to first circuit element 14 at connection location 42.

Figure 3:
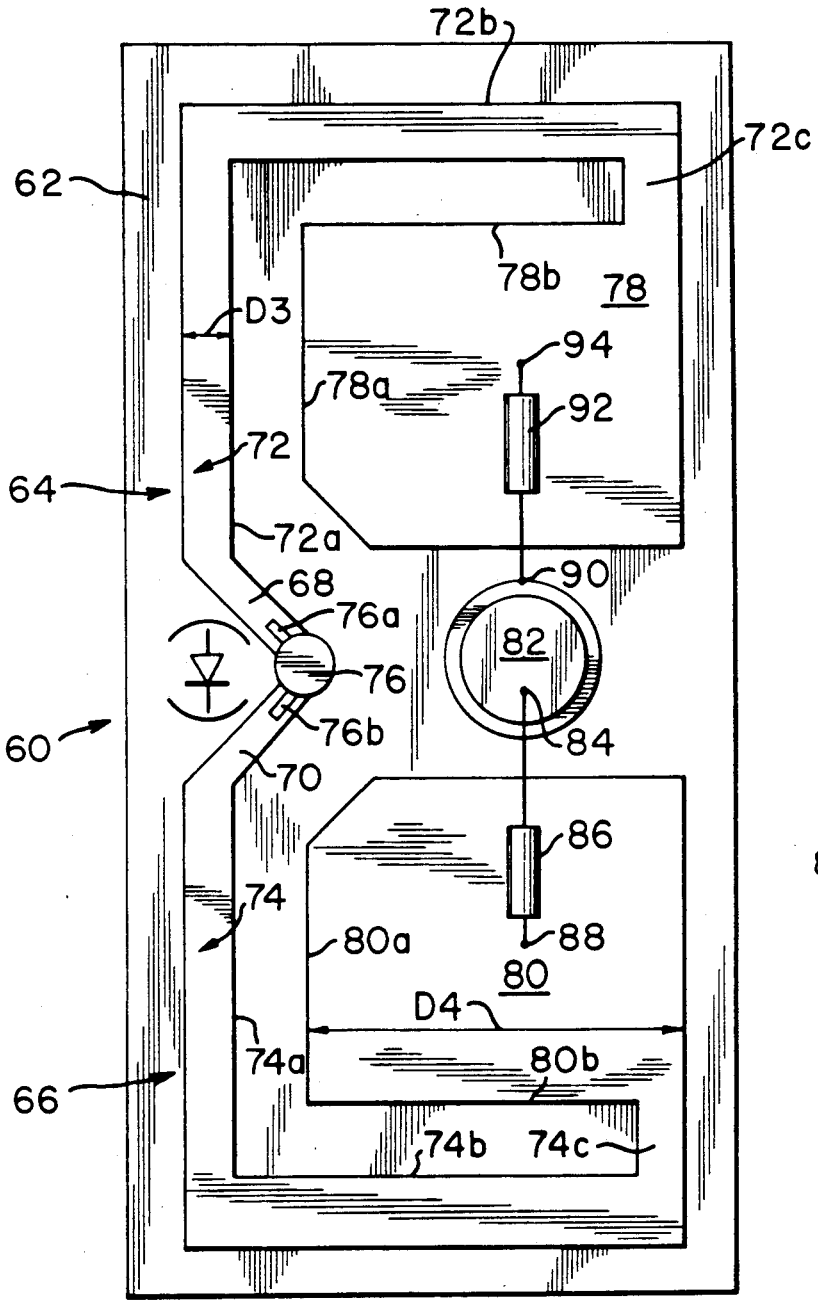
FIG. 3 is a top plan view of a modified version of the FIG. 1 type of tag device in accordance with the invention.
Figure 4:
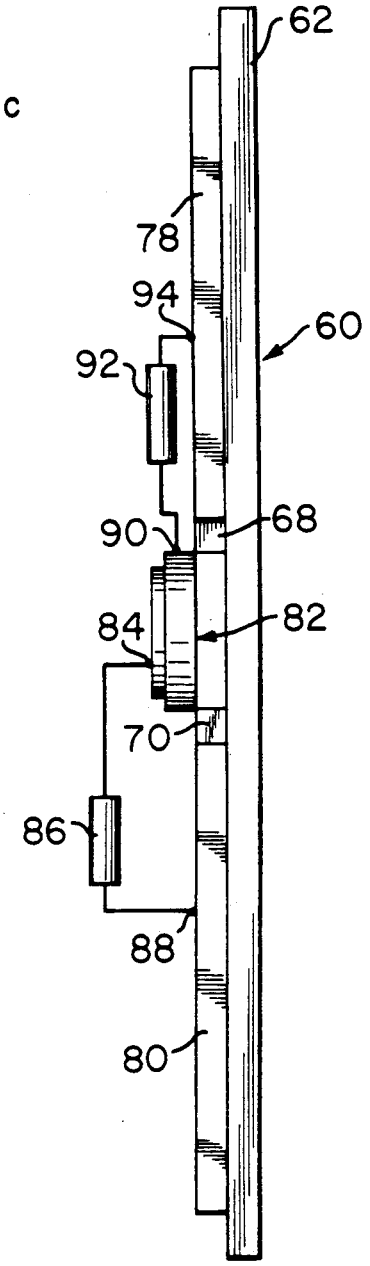
FIG. 4 is a right side elevation of the tag device of FIG. 3.

Turning to the modified tag embodiment of FIGS. 3 and 4, tag device 60 is of generally rectangular configuration and comprises an electrically insulative substrate 62 supporting various electrically conductive members. Such members comprise first circuit elements generally designated as 64 and 66, extending oppositely from the center of device 60 and including respectively transverse wings 68 and 70 and courses 72 and 74 of first transverse dimension D3. Courses 72 and 74 each include longitudinal portions **72*a* and 74*a* extending to opposed ends of substrate 62, transverse portions 72*b* and 74*b* and terminal portions 72*c* and 74*c*. Diode 76 is connected by its leads 76*a* and 76*b* in electrical series circuit with first circuit elements 64 and 66**.

The conductive members further include second circuit elements designated as 78 and 80 and of generally square outline and inclusive of respective transverse interior margin parts 78*a* and 80*a*, in spaced parallel relation with wings 68 and 70, respective longitudinal interior margin parts 78*b* and 80*b*, in spaced parallel relation with first circuit element portions 72*a* and 74*a*, and respective transverse outer marginal parts 78*b* and 80*b*, in spaced parallel relation with first circuit element portions 72*b* and 74*b*. Second circuit elements 78 and 80 are electrically continuous with terminal portions 72*c* and 74*c* of the first circuit element courses 72 and 74.

The transverse dimension of second circuit elements 78 and 80, indicated at D4, is substantially in excess of the transverse dimension D3 of first circuit elements 72 and 74, typically some five or more times D3, the geometric diversities of such circuit elements being assigned with a view toward providing selective different fixed inductive and capacitive reactances therein at the first and second frequencies received by tag device 60.

The tag device 60 thus far discussed is also shown in the '207 patent incorporated by reference above and further details as respects circuit element design may be obtained from the '207 patent. In accordance with the present invention, battery 82 has its negative terminal 84 connected through resistor 86 to first circuit element 66 at connection location 88 and its positive terminal 90 connected through resistor 92 to first circuit element 64 at connection location 94.

Figure 6:
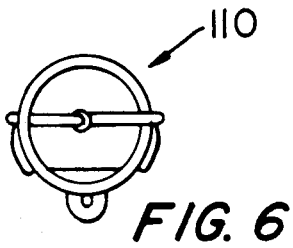
FIG. 6 is a top plan elevation of the FIG. 5 tag device.
Figure 5:
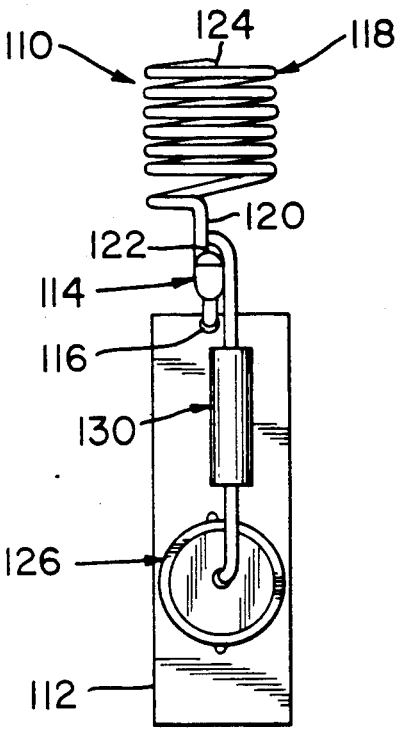
FIG. 5 is a front plan elevation of a second embodiment of a tag device in accordance with the invention.
Figure 7:
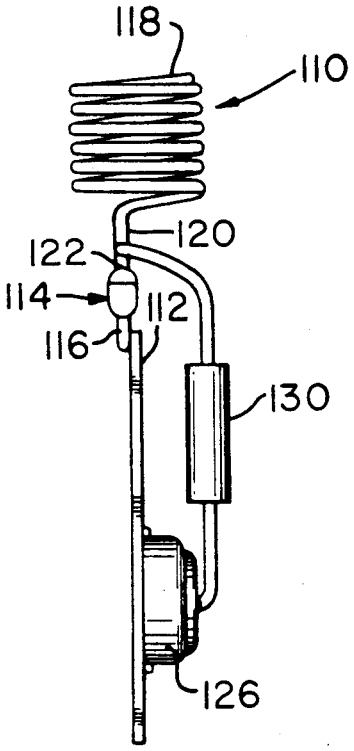
FIG. 7 is a right side elevation of the FIG. 5 tag device.

Referring to the second embodiment of the invention shown in FIGS. 5-7, tag device 110 includes an elongate, generally planar and electrically conductive member 112, constituting the ground plane of the tag device.

A nonlinear element 114, typically a diode, has one lead 116 thereof connected electrically, as by solder, to ground plane 112 adjacent to an end thereof.

Reradiator element 118 has one end 120 thereof electrically connected to a second lead 122 of diode 114 and its other end 124 without electrical connection thereto.

Ground plane 112 is typically a rectangular section of a conductive sheet, the dimensions of which are selected to minimize the overall size of the tag, yet maintaining the minimum required performance in a particular application. The optimum width to minimize the overall tag size is the same as the outside diameter of the spiral reradiator element.

Diode 114 is preferably a semiconductor diode, having high and low frequency characteristics selected desirably as described in the referenced '207 patent.

Reradiator element 118 is preferably a spiral inductor of dimensions selected to optimize the impedance match to cumulative impedance conditions presented by the inductor to the other two components, all such three components being connected electrically as a series circuit.

The function of reradiator element 118 is three-fold, namely, to receive and transmit high frequency energy, to serve as one side of an elementary dipole to capture low frequency electrostatic energy, typically 100 kHz, and to provide impedance matching at high frequency between the three components connected in series.

The function of diode 114 is that disclosed in the '207 patent, namely, to generate high frequency sidebands through reactance-modulation by applied low frequency electrostatic energy.

The function of ground plane 112 is two-fold, namely, to serve as the ground against which reradiator element 118 forms a monopole antenna and to serve as the second part of a dipole for low frequency electrostatic energy, as in the prior art endeavors described above.

Figure 8:
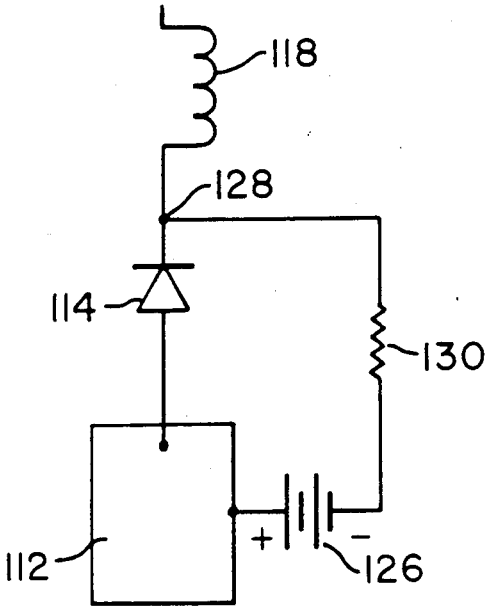
FIG. 8 is an electrical schematic diagram of the FIG. 5 tag device.

The foregoing second tag embodiment of the invention thus far described is that of the above-referenced copending application. In accordance with the present invention battery 126 is connected between the ground plane and the junction 128 of the diode and the spiral reradiator, with a resistor 130 connected as indicated in the electrical schematic of FIG. 8.

An evaluation method involves polar plotting of the distance at which a tag response (reradiation) is sensed with respect to a source transmitting-receiving location. The graphics programs show the response in the form of a polar diagram, where each circle represents a distance of ten inches. The full scale is of thirty inches and plots the response at 10 degree increments and computes a total for the readings, from which it computes an estimated pick rate. Computation is based on tag performance in a reference system installation used for correlation between standard test results and actual system pick rate.

Figure 9:
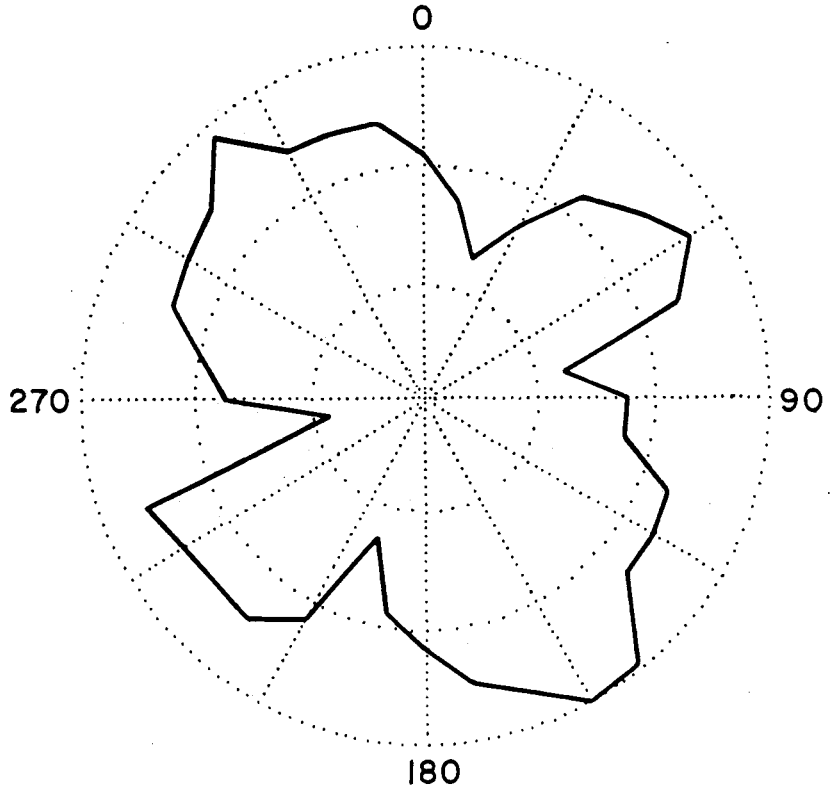
FIG. 9 is a polar plot of the performance characteristics of the FIG. 5 tag device without bias applied thereto.
Figure 10:
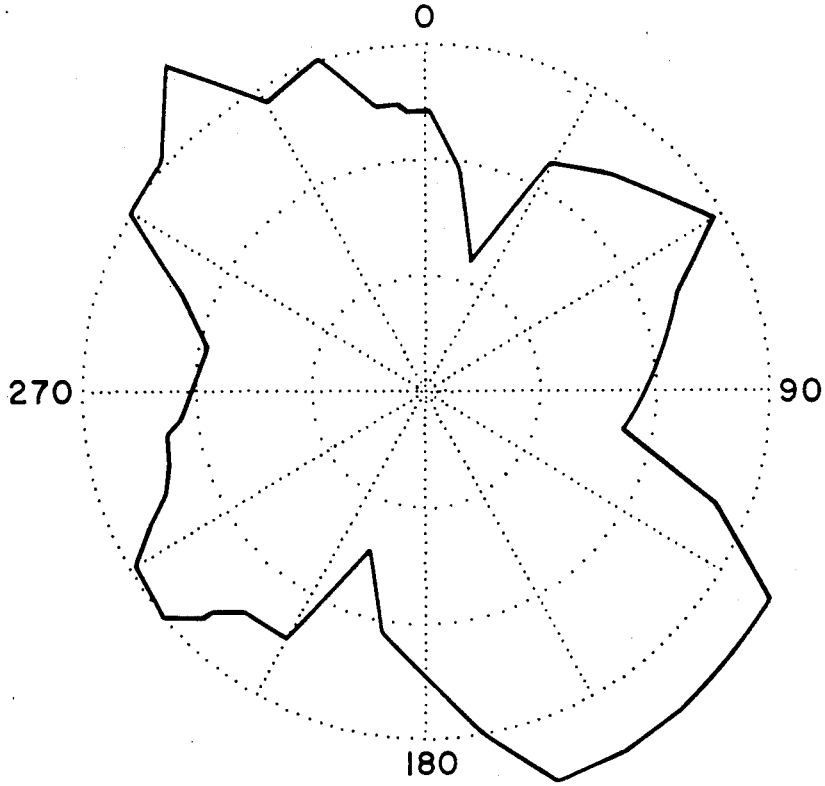
FIG. 10 is a polar plot of the performance characteristics of the FIG. 5 tag device with bias applied thereto.

FIG. 9 shows the performance of the tag of FIGS. 5-7 without bias and FIG. 10 with bias. Estimated pick rates in the reference system installation were seventy-three percent without bias, and ninety-three percent with bias.

Figure 11:
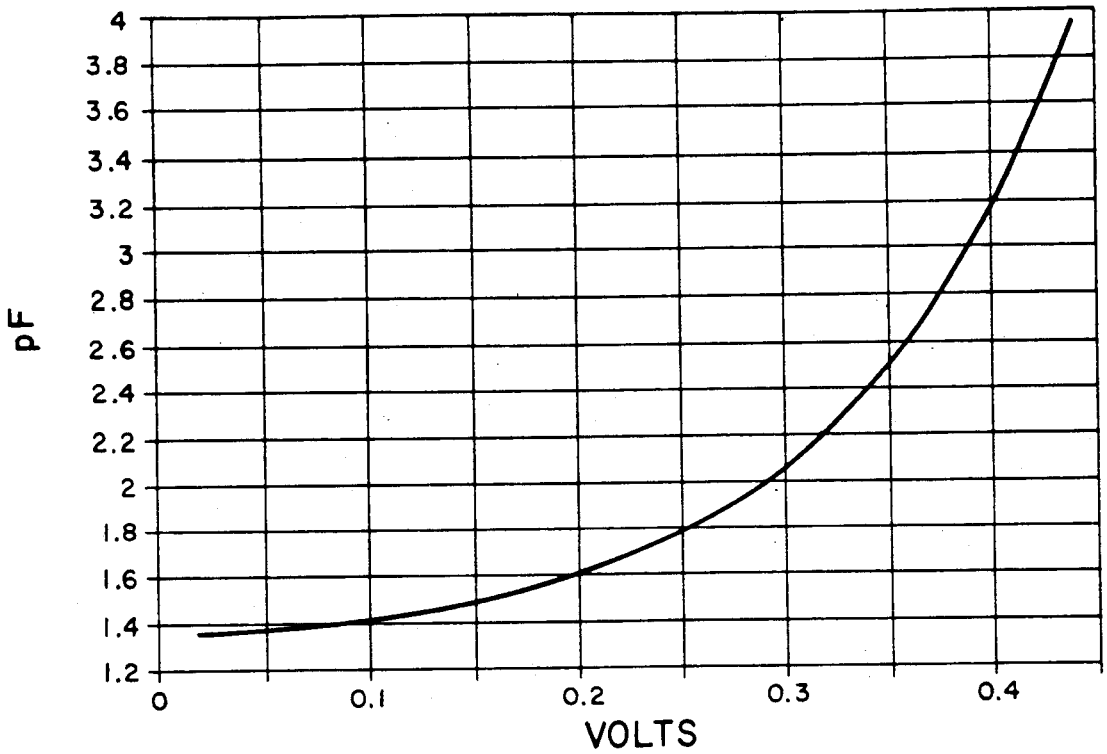
FIG. 11 is a plot of capacitance change with voltage change of an exemplary diode.

FIG. 11 shows that the capacitance-modulation parameter, subsequently referred to as the dC/dV ratio, and defined as incremental change in capacitance vs. incremental change in diode voltage, increases by the forward bias.

Figure 12:
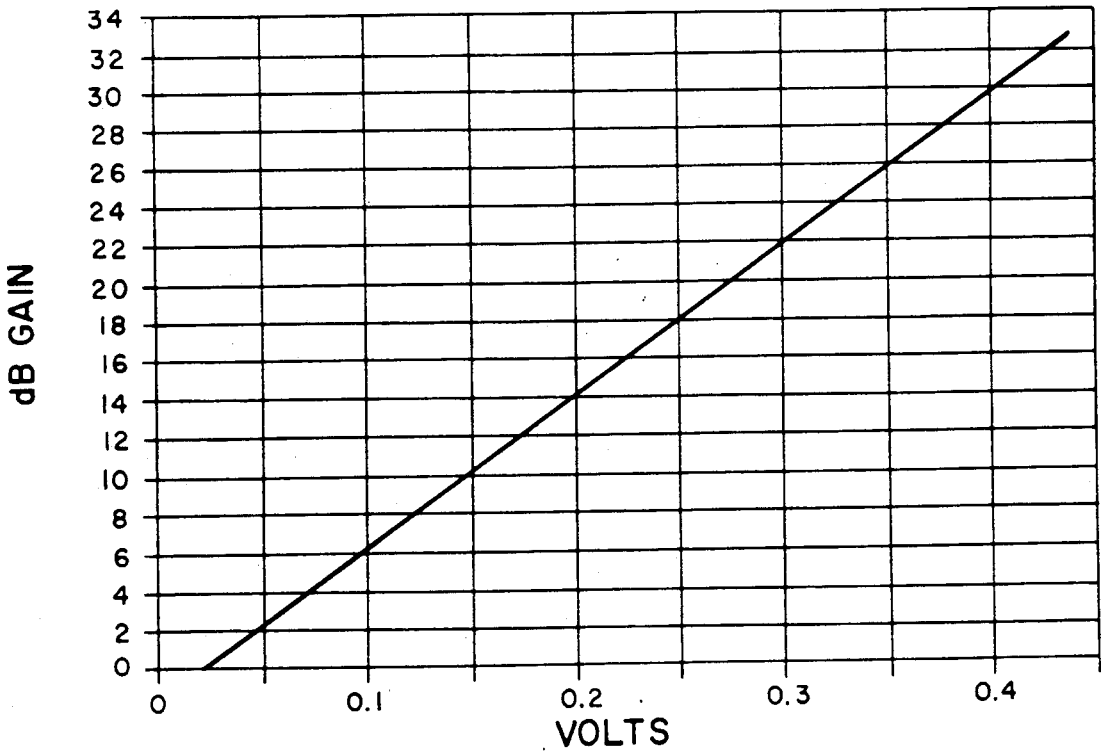
FIG. 12 presents the gain resulting from increased dC/dV slope factor vs. bias voltage, computed from FIG. 11 measurements and expressed in dB.

FIG. 12 presents the gain resulting from increased dC/dV slope factor vs. bias voltage, computed from FIG. 11 measurements and expressed in dB. Linear regression takes place in the bias range of interest to this invention.

Figure 13:
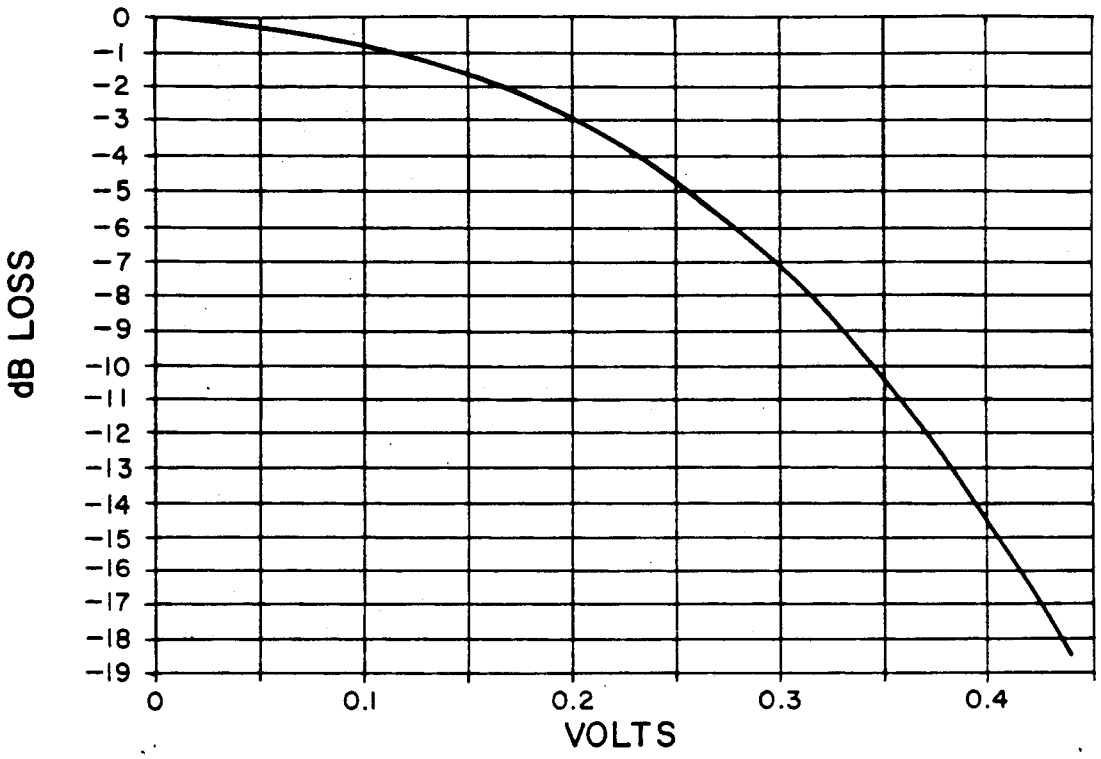
FIG. 13 presents results from a $1/c^2$ dB loss calculation.

As alluded to above, it has been determined that a high frequency tag performance is inversely proportional to the square of the overall capacitance. Consequently, if the diode operating point is shifted too far from the zero-bias state, although the dC/dV slope factor is improved, at the same time the square of the overall capacitance value rapidly takes effect and ultimately ruins the performance. Results from a dB loss calculation with respect to this factor (the $1/c^2$ factor) for a given diode is shown in FIG. 13. A gradually increasing loss takes place, until the $-6$ dB point is reached at around 0.28V bias, above which a rapid decline takes effect.

Figure 14:
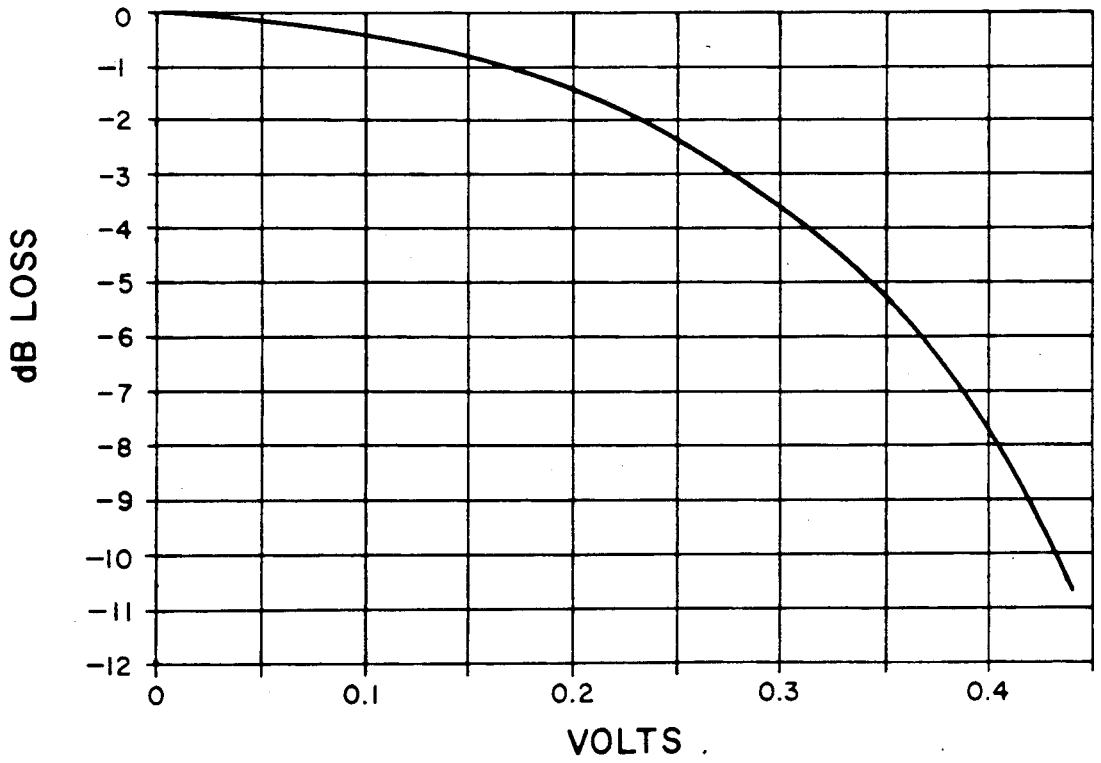
FIG. 14 shows the calculated dB loss vs. forward bias, resulting from degradation of the DC-impedance.

The amplitude of the low frequency voltage captured by the tag, and resulting tag performance, are directly proportional to the DC-impedance of the diode. As the operating point is biased further in forward direction, the current increases with resulting DC-impedance dropping exponentially. Again the loss of low frequency efficiency becomes dominant over the improvement in dC/dV slope factor. FIG. 14 shows the calculated dB loss vs. forward bias, resulting from degradation of the DC-impedance.

Depending on the type of diode used, the optimum forward bias varies between various diode types. As an example, Schottky diodes generally can not be enhanced by the practice of the invention, due to their inherently low DC impedance.

The practice under the subject invention, given the above-noted findings and recognitions and those further stated below, is to select the most suitable diode and to incorporate battery bias in such a manner that an optimum compromise is achieved between beneficial and detrimental effects of doing so.

The benefit of introducing bias is that capacitance-modulation efficiency improves through attaining an improved dC/dV ratio than would otherwise apply.

The detrimental effects of introducing bias are several. There is a degradation of high-frequency performance through increase in overall diode capacitance. Degradation of low-frequency impedance arises through increase in diode current and increase in overall diode capacitance. Degradation of low-frequency impedance also occurs through the loading effect of the bias network which is in parallel with diode. Lastly, a source for the bias voltage is needed, namely, a battery, and concern of course exists for battery life.

Figure 15:
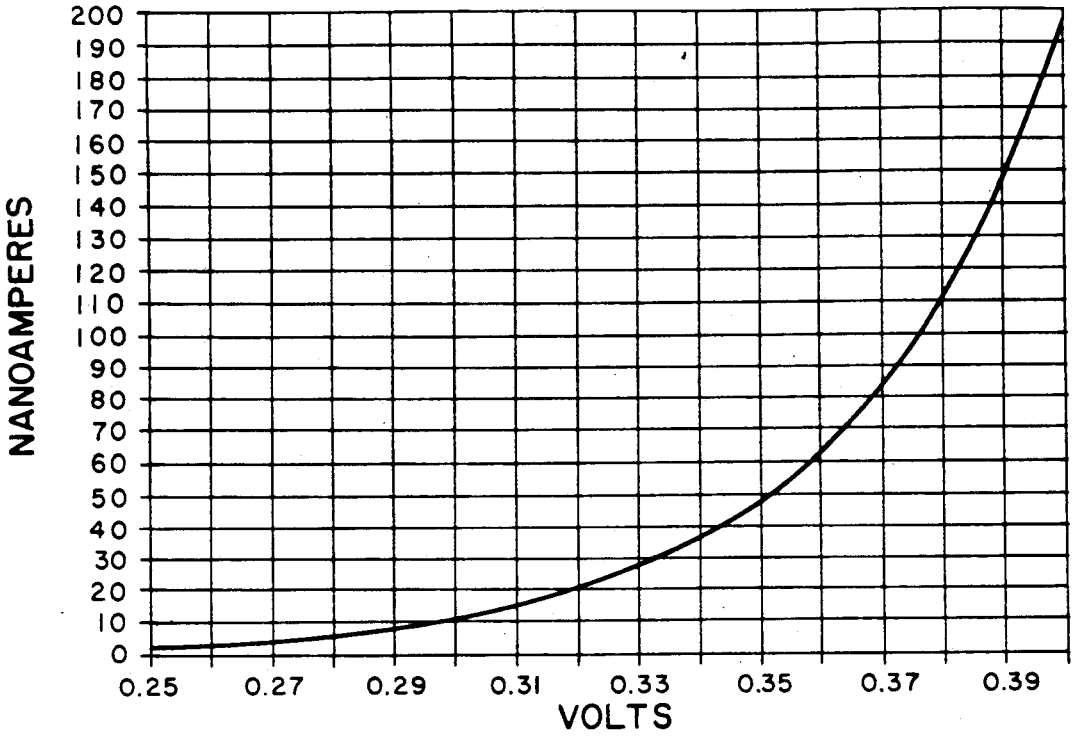
FIG. 15 shows the current vs. voltage characteristics of an exemplary diode.
Figure 16:
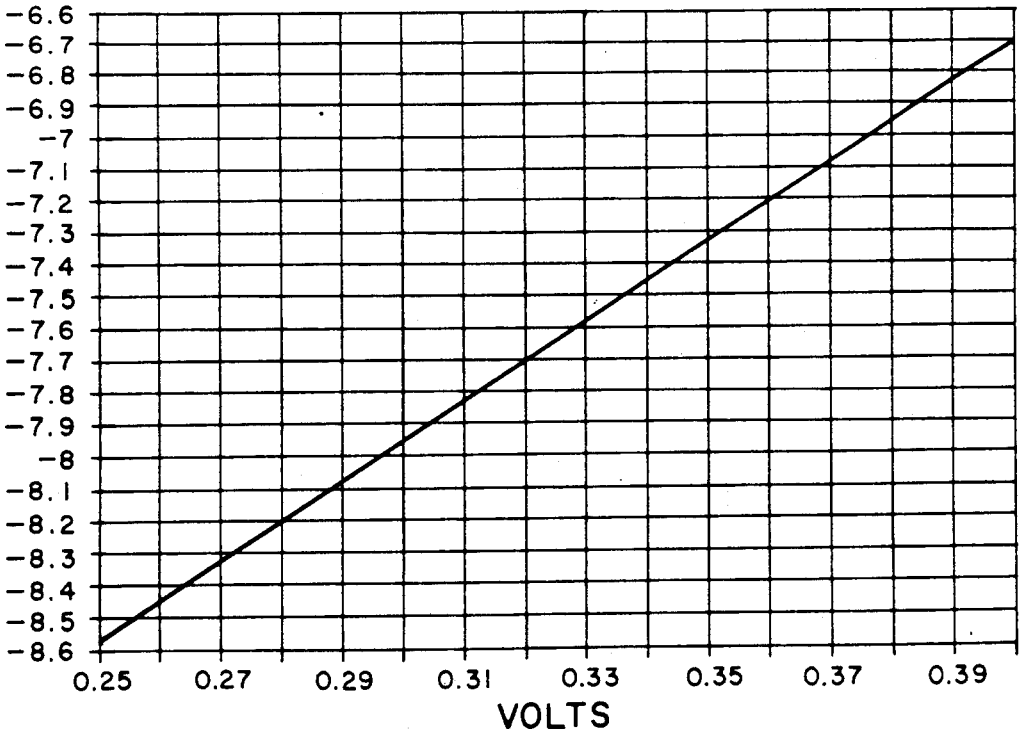
FIG. 16 shows the FIG. 15 characteristics on a logarithmic scale.
Figure 17:
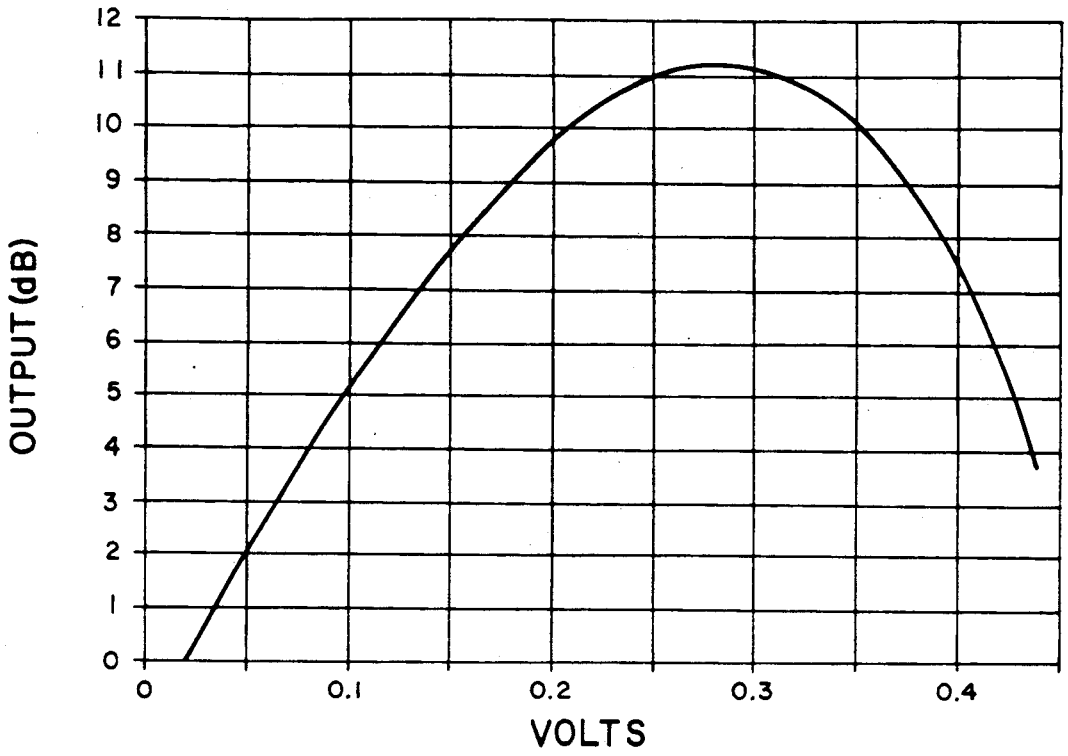
FIG. 17 presents results as a function of bias voltage.
Figure 18:
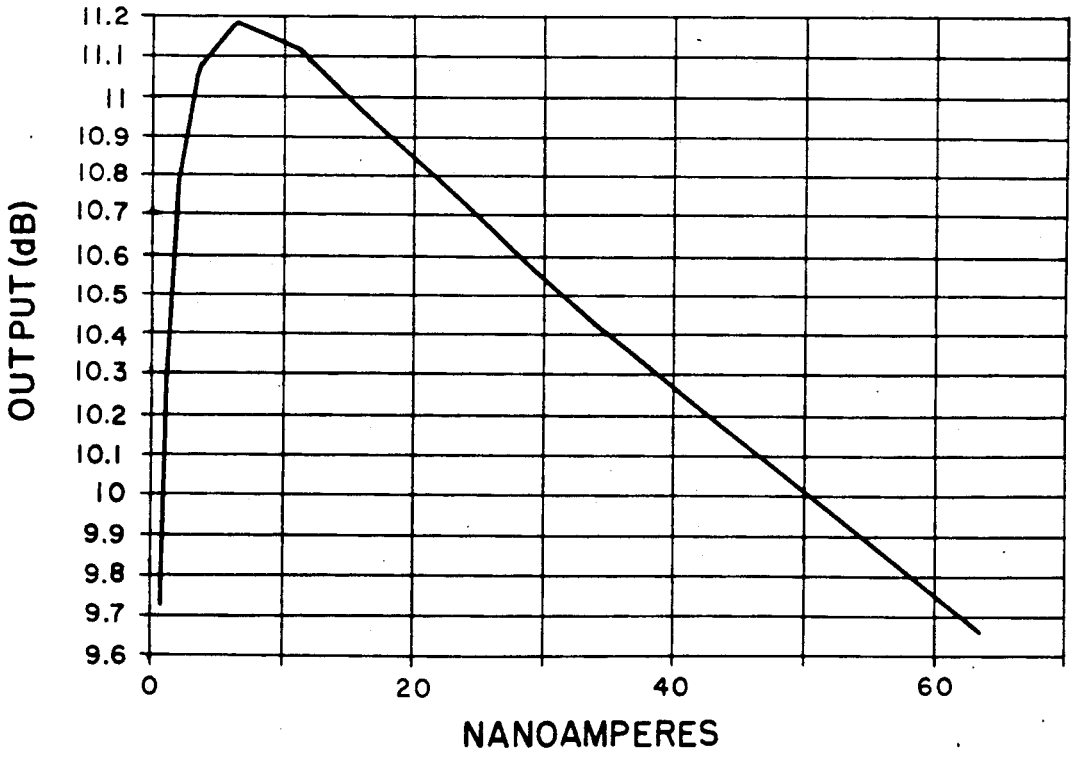
FIG. 18 presents results as a function of bias current.

FIG. 15 shows the current vs. voltage characteristics of an exemplary diode. FIG. 16 shows the same using a logarithmic scale. Combined effects of dC/dV slope factor, the $1/c^2$ factor, and the DC-impedance factor are calculated, based on FIG. 12 slope factor, FIG. 13 $1/c^2$ factor and FIG. 14 DC-impedance factor. FIG. 17 presents results, computed as a function of bias voltage, and FIG. 18 presents the same as a function of bias current. The optimum operating point from the two calculations is approximately 0.28V, which results in approximately 40 megohms as the value of the resistor or resistors in series with the battery, where the battery terminal voltage is 1.5V. As will be seen, the loading effect of the 40 megohm bias resistor is negligible.

By way of more specific disclosure of practice in accordance with the invention, the following analysis is provided. A reference bias voltage is taken as 0.02V, where the slope dC/dV is 0.5 pF/V. The slope factor gain, expressed in dB, is proportional to diode forward bias and provides a convenient model from which all AC (alternating current) characteristics are derived.

The dC/dV gain versus bias voltage (FIG. 12) follows the following relationship:

$$GAIN\ [db] = (78.082 \times Vd) - 1.54 \quad (1)$$

where the two constants are established as statistical mean values for a given diode evaluated.

The value of bias voltage providing optimum compromise is 0.28V and a comparison is now effected as between the reference bias voltage and the optimum bias voltage.

In terms of gain, equation (1) yields zero dB for the reference and 20.32 for the optimum. Now shown is the remnant dB gain after taking away the dB losses attributable to the $1/c^2$ factor and the DC-impedance factor.

The former loss follows the relationship:

$$LOSS\ [dB] = 20\ LOG\ ((1/c^2)/(0.542)) \quad (2)$$

where 0.542 is $1/c^2$ at the reference voltage.

At the reference voltage, the diode capacitance is 1.358 pF, and at the optimum voltage, the capacitance is 2.052 pF, and equation (2) yields zero loss at the reference voltage and a loss of 6.09 dB for the optimum.

The DC-impedance loss follows the relationship:

$$LOSS\ [dB] = 20\ LOG\ (Z/Zo) \quad (3)$$

where Zo is the impedance at the reference voltage.

Diode current follows the relationship:

$$Id = 10((12.464 \times Vd) - 11.6849) \quad (4)$$

where the two constants are established as statistical mean values of the diode under consideration.

Diode resistance follows the relationship:

$$R = Vd/Id \quad (5)$$

where Vd is the voltage across the diode. For the reference voltage, the diode resistance is $5.453 \times 10^9$ ohms. With a 40 megohm resistor in parallel with the diode, the effective resistance is 30.71 megohms.

Diode reactance follows the relationship:

$$X = 1/(2\pi fc) \quad (6)$$

At the frequency of 100 kilohertz, the reactance for the reference voltage is $1.172 \times 10^6$ ohms.

Diode impedance follows the relationship:

$$Z = R/(1 + (R^2/X^2))^{\frac{1}{2}} \quad (7)$$

which yields $1.172 \times 10^6$ ohms for Zo.

For the optimum voltage, the diode resistance is $43.87 \times 10^6$ ohms. With a 40 megohm resistor in parallel with the diode, the effective resistance is 20.92 megohms.

At the frequency of 100 kilohertz, the reactance for the optimum voltage is $8.256 \times 10^5$ ohms. The diode impedance at the optimum voltage computes as $8.249 \times 10^5$ ohms.

The DC-impedance loss at the reference voltage is zero and that at the optimum voltage is 3.05 dB.

Considering the gain at the optimum per equation (1) and the losses per equations (2) and (3), a net gain of 11.18 dB is effected.

If one effects the foregoing computations for 0.IV, 0.2V, 0.35V and 0.4V as the bias voltage, the results in net dB gain are respectively 5.07 dB, 9.73 dB, 10.11 dB and 7.46 dB. As will be appreciated each of these net dB gains are less than that achieved at the optimum bias value.

By way of summary of the foregoing and by way of introduction to the ensuing claims, the invention will be seen to have various aspects. In one aspect, it provides a tag for use in an electronic article surveillance system of the type comprising a transmitter-receiver arrangement disposed aside an area to be controlled for transmitting a first high-frequency signal into the area, a transmitter disposed aside the area and generating a second frequency signal of substantially lower frequency than the first frequency for establishing in the area an electrostatic field, a tag for attachment to an article to be subject to surveillance and responsive to the incidence thereon of energy of both the first and second frequencies to transmit a composite thereof and receiver apparatus disposed aside the area for receipt and detection of such composite signal and for generation of an output signal indicative of such detection, the tag comprising: an antenna for receiving the first and second transmitted signals and for transmitting the composite signal; a nonlinear circuit for connection electrically with the antenna and responsive to energy derived from the second transmitted signal received by the antenna to exhibit electrical reactance change with change of voltage of the energy; and an electrical power supply unit connected to the antenna and the nonlinear circuit an operative to enhance the electrical reactance change of the nonlinear circuit.

The antenna may comprise a reradiator element and an electrical ground plane member connected electrically to the nonlinear circuit. The reradiator element, the nonlinear circuit and the ground plane member are in electrical series circuit connection, the electrical power supply being connected between the ground plane member and a junction connection of the reradiator element and the nonlinear circuit. The electrical power supply may include a battery and a resistor connected to a terminal of the battery and to either of the reradiator element or the ground plane member. The nonlinear circuit may have capacitive reactance as the electrical reactance and is adapted to generate high frequency sidebands through capacitance-modulation responsive to receipt of energy derived from the second transmitted signal. The ground plane member may exhibit a dimension substantially equal to a dimension exhibited by the reradiator element. The reradiator element may comprise a spiral inductor. The ground plane member may be elongate and have a width dimension substantially equal to the outside diameter of the spiral inductor. The tag may be elongate, the reradiator element having a central axis longitudinally disposed with the tag, the nonlinear circuit and the ground plane member being disposed in general alignment with the central axis. The nonlinear circuit may be a diode. The ground plane member may be a conductive sheet.

In a second aspect, the invention will be seen to provide, in combination in an electronic article surveillance tag: a reradiator element; a nonlinear element connected electrically to the reradiator element; an electrical ground plane member connected electrically to the nonlinear element; and an electrical power supply connected to the reradiator element and the nonlinear element, the reradiator element, the nonlinear element and the ground plane member being in electrical series circuit connection, the reradiator element and the ground plane member defining a monopole antenna upon incidence on the tag of high frequency energy for reradiation of the high frequency energy.

In a third aspect, the invention will be seen to provide a tag for use in the first aspect system with such power supply wherein the antenna is of generally rectangular configuration and comprises first circuit elements extending longitudinally of the tag and of first transverse dimension, second circuit elements extending longitudinally of the tag at least in part jointly with a respective first circuit element and of second transverse dimension substantially exceeding the first transverse dimension and effecting predominant different receipt by the first and second circuit elements of the transmitted first and second signals and wherein the nonlinear circuit is connected in electrical series circuit with the first and second circuit elements. In this third aspect, the electrical power supply may comprise a battery located on one of the second circuit elements and electrically connected thereto and further electrically connected to one of the first circuit elements. The electrical power supply may further include a resistor connected between the battery and one of the first and second circuit elements. Otherwise, the electrical power supply may comprise a battery located in spaced relation to the first and second circuit elements. The battery may have positive and negative terminals which are electrically connected respectively to distinct second circuit elements and the electrical power supply may further include resistors connected between the battery terminals and the second circuit elements.

In a fourth aspect, the invention will be seen to provide, in a method for enhancing the performance of tags for use in an electronic article surveillance system of the type comprising a transmitter-receiver arrangement disposed aside an area to be controlled for transmitting a first high-frequency signal into the area, a transmitter disposed aside the area and generating a second frequency signal of substantially lower frequency than the first frequency for establishing in the area an electrostatic field, a tag for attachment to an article to be subject to surveillance, the tag being responsive to the incidence thereon of energy of both the first and second frequencies to transmit a composite thereof and receiver apparatus disposed aside the area for receipt and detection of such composite signal and for generation of an output signal indicative of such detection, the method involving the steps of: configuring the tag with: an antenna for receiving the first and second transmitted signals and for transmitting the composite signal; and a nonlinear circuit for connection electrically with the antenna and responsive to energy derived from the second transmitted signal received by the antenna to exhibit electrical reactance change with change of voltage of the energy; and applying an electrical bias of steady-state nature to the tag dependently on consideration of characteristics of the nonlinear circuit to enhance the electrical reactance change thereof responsively to the energy derived from the second transmitted signal received by the antenna. The considered characteristics of the nonlinear circuit are selected to be a dC/dV slope factor, a $1/c^2$ factor and a DC-impedance factor. The nonlinear circuit is selected to be a diode.

Various changes may evidently be introduced in the foregoing structure without departing from the invention. Thus, the particularly described and preferred embodiments and practices are intended to be illustrative and not limiting of the invention. The true spirit and scope of the invention is set forth in the appended claims.

What is claimed is:

1. A tag for use in an electronic article surveillance system of the type comprising a transmitter-receiver arrangement disposed aside a area to be controlled for transmitting a first high-frequency signal into said area, a transmitter disposed aside said area and generating a second frequency signal of substantially lower frequency than said first frequency for establishing in said area an electrostatic field, a tag for attachment to an article to be subject to surveillance, said tag being responsive to the incidence thereon of energy of both said first and second frequencies to transmit a composite thereof and receiver apparatus disposed aside said area for receipt and detection of such composite signal and for generation of an output signal indicative of such detection, said tag comprising:

(a) antenna means for receiving said first and second transmitted signals and for transmitting said composite signal;

(b) nonlinear circuit means for connection electrically with said antenna means and responsive to energy derived from said second transmitted signal received by said antenna means to exhibit electrical reactance change with change of voltage of said energy; and (c) electrical power supply means connected to said antenna means and said nonlinear circuit means and operative to enhance said electrical reactance change of said nonlinear circuit means.

2. The invention claimed in claim 1 wherein said antenna means comprises a reradiator element and an electrical ground plane member connected electrically to said nonlinear circuit means.

3. The invention claimed in claim 2 wherein said reradiator element, said nonlinear circuit means and said ground plane member are in electrical series circuit connection, said electrical power supply means being connected between said ground plane member and a junction connection of said reradiator element and said nonlinear circuit means.

4. The invention claimed in claim 3 wherein said electrical power supply means includes a battery and a resistor connected to a terminal of said battery and to either of said reradiator element or said ground plane member.

5. The invention claimed in claim 2 wherein said nonlinear circuit means has capacitive reactance as said electrical reactance and is adapted to generate high frequency sidebands through capacitance-modulation responsive to receipt of energy derived from said second transmitted signal.

6. The invention claimed in claim 2 wherein said ground plane member exhibits a dimension substantially equal to a dimension exhibited by said reradiator element.

7. The invention claimed in claim 2 wherein said reradiator element comprises a spiral inductor.

8. The invention claimed in claim 7 wherein said ground plane member is elongate and has a width dimension substantially equal to the outside diameter of said spiral inductor.

9. The invention claimed in claim 2 wherein said tag is elongate, said reradiator element having a central axis longitudinally disposed with said tag, said nonlinear circuit means and said ground plane member being disposed in general alignment with said central axis.

10. The invention claimed in claim 2 wherein said nonlinear circuit means is a diode.

11. The invention claimed in claim 2 wherein said ground plane member is a conductive sheet.

12. The invention claimed in claim 1 wherein said antenna means is of generally rectangular configuration and comprises first circuit elements extending longitudinally of the tag and of first transverse dimension, second circuit elements extending longitudinally of the tag at least in part jointly with a respective first circuit element and of second transverse dimension substantially exceeding the first transverse dimension and effecting predominant different receipt by the first and second circuit elements of the transmitted first and second signals and wherein said nonlinear circuit means is connected in electrical series circuit with the first and second circuit elements.

13. The invention claimed in claim 12 wherein said electrical power supply means comprises a battery located on one of said second circuit elements and electrically connected thereto and further electrically connected to one of said first circuit elements.

14. The invention claimed in claim 13 wherein said electrical power supply means further includes a resistor connected between said battery and one of said first and second circuit elements.

15. The invention claimed in claim 12 wherein said electrical power supply means comprises a battery located in spaced relation to said first and second circuit elements.

16. The invention claimed in claim 15 wherein said battery has positive and negative terminals which are electrically connected respectively to distinct said second circuit elements.

17. The invention claimed in claim 16 wherein said electrical power supply further includes resistors connected between said battery terminals and said second circuit elements.

18. In combination in an electronic article surveillance tag:

(a) a reradiator element;

(b) a nonlinear element connected electrically to said reradiator element;

(c) an electrical ground plane member connected electrically to said nonlinear element; and (d) electrical power supply means connected to said reradiator element and said nonlinear element, said reradiator element, said nonlinear element and said ground plane member being in electrical series circuit connection, said reradiator element and said ground plane member defining a monopole antenna upon incidence on said tag of high frequency energy for reradiation of said high frequency energy.

19. The invention claimed in claim 18 wherein said reradiator element, said nonlinear circuit means and said ground plane member are in electrical series circuit connection, said electrical power supply means being connected between said ground plane member and a junction connection of said reradiator element and said nonlinear circuit means.

20. The invention claimed in claim 19 wherein said electrical power supply means includes a battery and a resistor connected to a terminal of said battery and to either of said reradiator element or said ground plane member.

21. The invention claimed in claim 18 wherein said ground plane member exhibits a dimension substantially equal to a dimension exhibited by said reradiator element.

22. The invention claimed in claim 18 wherein said reradiator element comprises a spiral inductor.

23. The invention claimed in claim 22 wherein said ground plane member is elongate and has a width dimension substantially equal to the outside diameter of said spiral inductor.

24. The invention claimed in claim 18 wherein said tag is elongate, said reradiator having a central axis longitudinally disposed with said tag, said nonlinear element and said ground plane member being disposed in general alignment with said central axis.

25. The invention claimed in claim 18 wherein said nonlinear element is a diode.

26. The invention claimed in claim 18 wherein said ground plane member is a conductive sheet.

27. In combination in an electronic article surveillance tag:

(a) antenna means of generally rectangular configuration comprising first circuit elements extending longitudinally of the tag and of first transverse dimension, second circuit elements extending longitudinally of the tag at least in part jointly with a respective first circuit element and of second transverse dimension substantially exceeding the first transverse dimension;

(b) nonlinear circuit means connected in electrical series circuit with the first and second circuit elements; and (c) electrical power supply means electrically connected with said nonlinear circuit means for imparting bias thereto.

28. The invention claimed in claim 27 wherein said electrical power supply means comprises a battery located on one of said second circuit elements and electrically connected thereto and further electrically connected to one of said first circuit elements.

29. The invention claimed in claim 28 wherein said electrical power supply means further includes a resistor connected between said battery and one of said first and second circuit elements.

30. The invention claimed in claim 27 wherein said electrical power supply means comprises a battery located in spaced relation to said first and second circuit elements.

31. The invention claimed in claim 30 wherein said battery has positive and negative terminals which are electrically connected respectively to distinct said second circuit elements.

32. The invention claimed in claim 31 wherein said electrical power supply further includes resistors connected between said battery terminals and said second circuit elements.

33. A method for enhancing the performance of tags for use in an electronic article surveillance system of the type comprising a transmitter-receiver arrangement disposed aside an area to be controlled for transmitting a first high-frequency signal into said area, a transmitter disposed aside said area and generating a second frequency signal of substantially lower frequency than said first frequency for establishing in said area an electrostatic field, a tag for attachment to an article to be subject to surveillance, said tag being responsive to the incidence thereon of energy of both said first and second frequencies to transmit a composite thereof and receiver apparatus disposed aside said area for receipt and detection of such composite signal and for generation of an output signal indicative of such detection, involving the steps of:

(a) configuring said tag with:

(1) antenna means for receiving said first and second transmitted signals and for transmitting said composite signal; and (2) nonlinear circuit means for connection electrically with said antenna means and responsive to energy derived from said second transmitted signal received by said antenna means to exhibit electrical reactance change with change of voltage of said energy; and (b) applying an electrical bias of steady-state nature to said tag dependently on consideration of characteristics of said nonlinear circuit means to enhance said electrical reactance change thereof responsively to said energy derived from said second transmitted signal received by said antenna means.

34. The invention claimed in claim 33 wherein said considered characteristics of said nonlinear circuit means are selected to be a dC/dV slope factor, a $1/c^2$ factor and a DC-impedance factor.

35. The invention claimed in claim 34 wherein said nonlinear circuit means is selected to be a diode.

* * * * *